US005735570A

United States Patent [19]

Tseng

[11] Patent Number: 5,735,570

[45] Date of Patent: Apr. 7, 1998

[54] FOLDABLE CHAIR FRAME

[75] Inventor: Chuen-Jong Tseng, Chiayi Hsien, Taiwan

[73] Assignee: Shin Yen Enterprise Co., Ltd., Taiwan

[21] Appl. No.: 870,224

[22] Filed: Jun. 6, 1997

[51] Int. Cl.[6] ..... A47C 4/00

[52] U.S. Cl. ..... 297/39; 297/35

[58] Field of Search ..... 297/16, 35, 39, 297/46, 47; 403/85, 92, 101

[56] References Cited

U.S. PATENT DOCUMENTS

| | | | |
|---|---|---|---|
| 2,957,516 | 10/1960 | Kubisz | 297/39 X |
| 2,964,099 | 12/1960 | Panicci | 297/39 X |
| 3,058,773 | 10/1962 | Panicci | 297/35 |
| 4,536,026 | 8/1985 | Cornell | 297/39 |
| 4,772,068 | 9/1988 | Gleckler et al. | 297/39 |
| 4,963,762 | 10/1990 | Brooks | 297/39 X |
| 5,054,848 | 10/1991 | Liu | 297/39 |

*Primary Examiner*—Peter R. Brown
*Attorney, Agent, or Firm*—Ladas & Parry

[57] ABSTRACT

A foldable chair frame has a pair of positioning device, each of which includes a stationary pivot seat for mounting pivotally a post of a back frame portion to a respective rail of a seat frame portion of the chair frame, and a movable pivot seat mounted pivotally on the stationary pivot seat by means of a first pivot shaft that extends through an upper end of the movable pivot seat and through the stationary pivot seat. The movable pivot seat has a rear leg portion of the chair frame mounted pivotally thereon by means of a second pivot shaft that extends through a lower end thereof. The movable pivot seat further has an outer side formed with a retaining protrusion. The positioning device further includes a retaining sleeve which is formed with a stop member and which is movable along a respective one of the rear leg portions between a first position, in which the stop member engages the retaining protrusion so as to arrest relative movement between the first and second pivot shafts for retaining the foldable chair frame in an unfolded position, and a second position, in which the stop member is released from the movable pivot seat to permit relative movement between the first and second pivot shafts when the lower ends of the second pivot plates are moved forwardly relative to the upper end of the movable pivot seat to fold the chair frame.

1 Claim, 7 Drawing Sheets

FOLDABLE CHAIR FRAME

BACKGROUND OF THE INVENTION

1. Field of the Invention

The present invention relates to a foldable chair frame, more particularly to a foldable chair frame having a positioning device for positioning the chair frame in an unfolded position in a relatively stable manner.

2. Description of the Related Art

Referring to FIG. 1, a conventional foldable chair frame 1' is shown to include a back frame portion 13' with a parallel pair of upright posts 131', a seat frame portion 11' with a parallel pair of horizontal rails 111', and a piece of cloth 110' extending between the pair of upright posts 131' and between the pair of horizontal rails 111' to form a backrest and a seat on the chair frame. Each of the posts 131' has a lower end mounted pivotally to a rear end of a respective one of the horizontal rails 111' by means of a first pivot seat 12'. A pair of armrests 14' are mounted pivotally on the upright posts 131', respectively. A U-shaped front support 15' has a pair of front legs 151' which have upper ends mounted pivotally to the pair of armrests 14', respectively, lower ends supported on a ground surface, and intermediate sections mounted pivotally on the pair horizontal rails 111', respectively. A U-shaped rear support 16' has a pair of rear legs 161' which have upper ends mounted pivotally to the pair of armrests 14', respectively, lower ends supported on the ground surface, and intermediate sections between the upper and lower ends thereof. The intermediate section of each of the rear legs 161' is mounted pivotally to a respective one of the horizontal rails 111' of the seat frame portion 11' and a respective one of the upright posts 131' of the back frame portion 13' by means of a second pivot seat 20.

Since neither of the first and second pivot seats 12', 20 is provided with means for positioning the conventional chair frame 1' in an unfolded position, the chair frame 1' might be easily and undesirably folded when the lower end of one of the front and rear supports 15', 16' is accidentally pushed inwardly by an external force. Inconvenience results, and the user's safety cannot be ensured.

SUMMARY OF THE INVENTION

The main object of the present invention is to provide a foldable chair frame with a positioning device which is easily operable for positioning the chair frame in an unfolded position to result in enhanced safety for the user.

Accordingly, the foldable chair frame of the present invention includes a back frame portion, a seat frame portion, a front support, a rear support, a parallel pair or arm rests and a pair of positioning devices.

The back frame portion has a parallel pair of upright posts with lower ends. The seat frame portion has a parallel pair of horizontal rails with rear ends. The front support has a parallel pair of front legs, each of which has a lower end adapted to be supported on a ground surface, an upper end, and an intermediate section with a respective one of the rails of the seat frame portion mounted pivotally thereon. The rear support has a parallel pair of rear legs, each of which has a lower end adapted to be supported on the ground surface, an upper end, and an intermediate portion between the upper and lower ends thereof. The pair of arm rests are disposed on opposite sides of the back frame portion. Each of the arm rests has a rear end portion mounted pivotally to a respective one of the upright posts of the back frame portion, an intermediate portion with the upper end of a respective one of the rear legs of the rear support mounted pivotally thereon, and a front end portion with the upper end of a respective one of the front legs of the front support mounted pivotally thereon.

Each of the positioning devices includes a stationary pivot seat, a movable pivot seat, a first pivot shaft and a second pivot shaft. The stationary pivot seat has a parallel pair of first pivot plates. The lower end of a respective one of the posts of the back frame portion and the rear end of a respective one of the rails of the seat frame portion extend between the first pivot plates and are mounted pivotally on the first pivot plates. The movable pivot seat has a parallel pair of second pivot plates, each of which has an upper end and a lower end. At least one of the second pivot plates has an outer side formed with a retaining protrusion between the upper and lower ends thereof. The first pivot shaft extends transversely through the upper ends of the second pivot plates of the movable pivot seat and through the first pivot plates of the stationary pivot seat so as to mount pivotally the movable pivot seat on the stationary pivot seat. The second pivot shaft extends through the lower ends of the second pivot plates of the movable pivot seat and a respective one of the rear legs of the rear support so as to mount pivotally the respective one of the rear legs to the movable pivot seat. The retaining sleeve is sleeved movably on a respective one of the rear legs between an adjacent one of the arm rests and the movable pivot seat. The retaining sleeve is formed with a stop member and is movable along the respective one of the rear legs between a first position, in which the stop member engages one side of the retaining protrusion so as to arrest relative movement between the first and second pivot shafts for retaining the foldable chair frame in an unfolded position, and a second position, in which the stop member is released from the movable pivot seat to permit relative movement between the first and second pivot shafts when the lower ends of the second pivot plates are moved forwardly relative to the upper ends of the second pivot plates to fold the chair frame.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
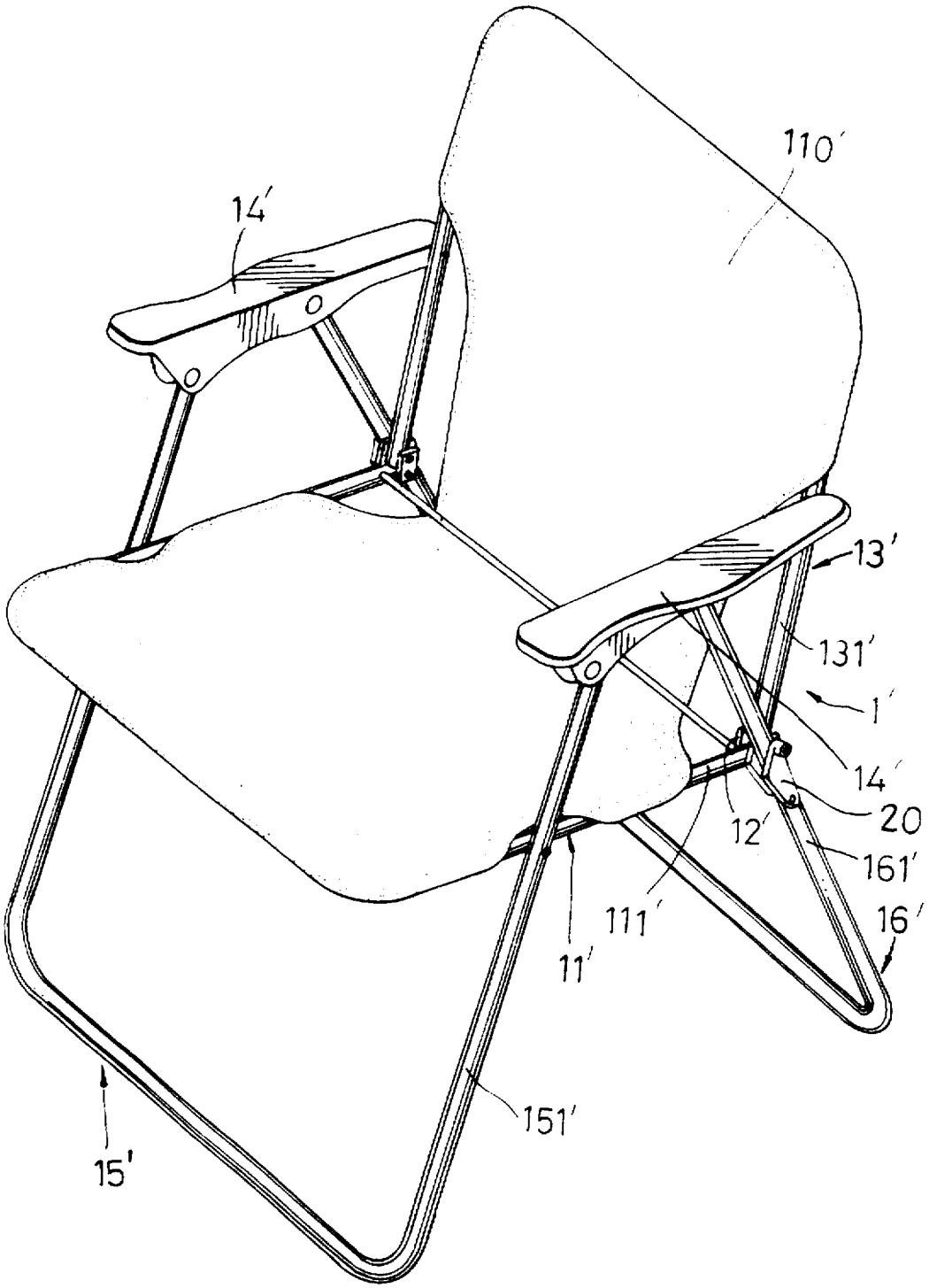
FIG.1 PRIOR ART
FIG. 1 is a perspective view illustrating a conventional foldable chair frame.
Figure 2:
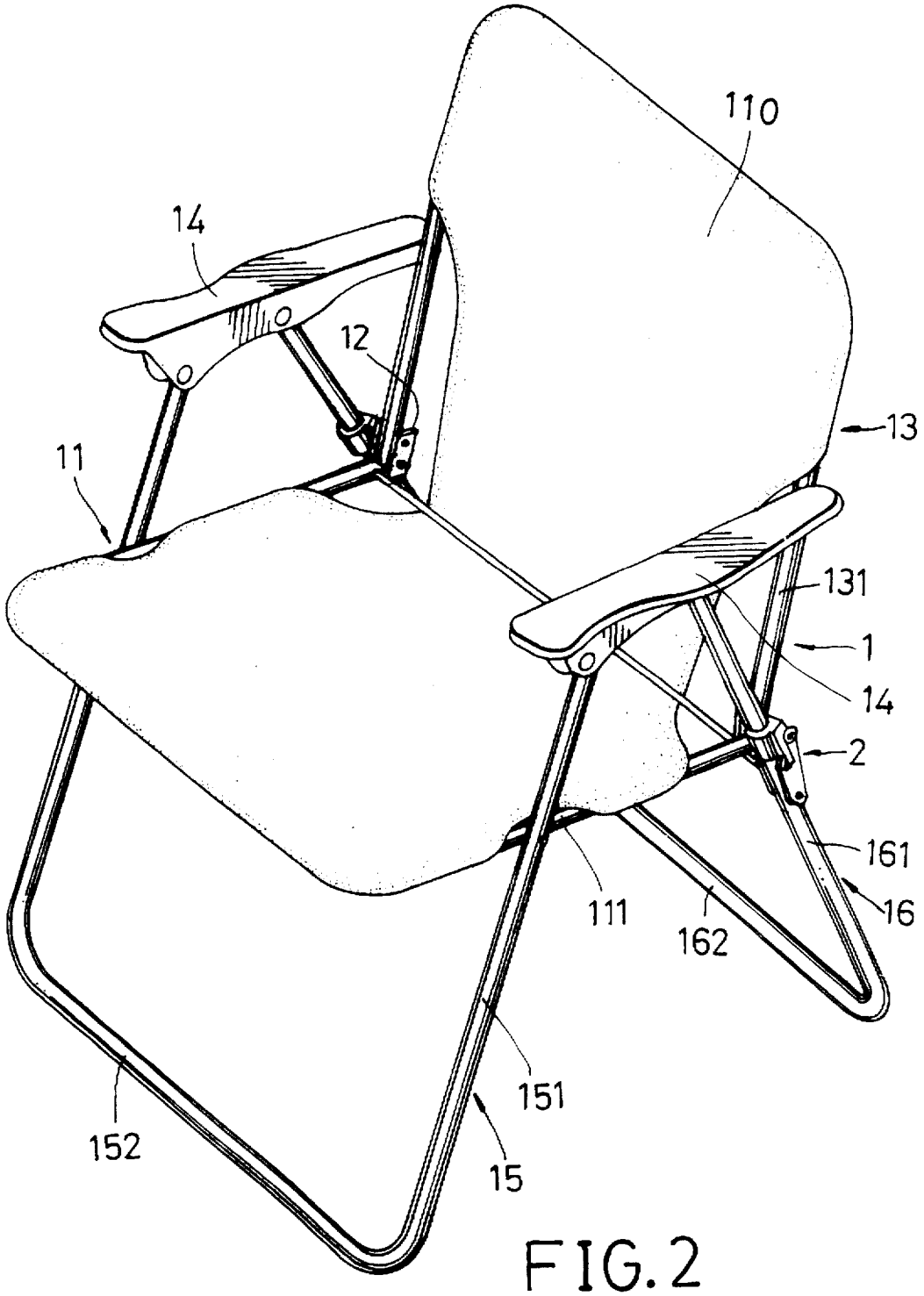
FIG. 2 is a perspective view illustrating a foldable chair frame according to a first preferred embodiment of the present invention.

Referring to FIG. 2, the foldable chair frame 1 according to a first preferred embodiment of the present invention is shown to include a back frame portion 13, a seat frame portion 11, a front support 15, a rear support 16, a parallel pair of arm rests 14 and a pair of positioning devices 2.

The back frame portion 13 has a substantially U-shaped configuration and a pair of upright posts 131 with lower ends. The seat frame portion 11 similarly has a substantially U-shaped configuration and a pair of horizontal rails 111 with rear ends. A piece of cloth 110 extends between the pair of upright posts 131 and between the pair horizontal rails 111 so as to form a backrest and a seat. The front support 15 has a parallel pair of front legs 151, each of which has an upper end, a lower end, and an intermediate section mounted pivotally on an outer side of a respective one of the horizontal rails 111 of the seat frame portion 11. The front support 15 further has a front bottom rail 152 which interconnects the lower ends of the pair of front legs 151 and which is adapted to be supported on a ground surface. The rear support 16 has a parallel pair of rear legs 161, each of which has an upper end, a lower end, and an intermediate portion between the upper and lower ends thereof. The rear support 16 further has a rear bottom rail 162 which interconnects the lower ends of the pair of rear legs 161 and which is adapted to be supported on the ground surface. The front legs 151 incline downwardly and forwardly while the rear legs 161 incline downwardly and rearwardly so as to support the chair frame 1 in an unfolded position. The arm rests 14 are disposed on opposite sides of the back frame portion 13. Each of the arm rests 14 has a rear end portion mounted pivotally to a respective one of the upright posts 131 of the back frame portion 13, an intermediate portion with the upper end of a respective one of the rear legs 161 of the rear support 16 mounted pivotally thereon, and a front end portion with the upper end of a respective one of the front legs 151 of the front support 15 mounted pivotally thereon.

Figure 3:
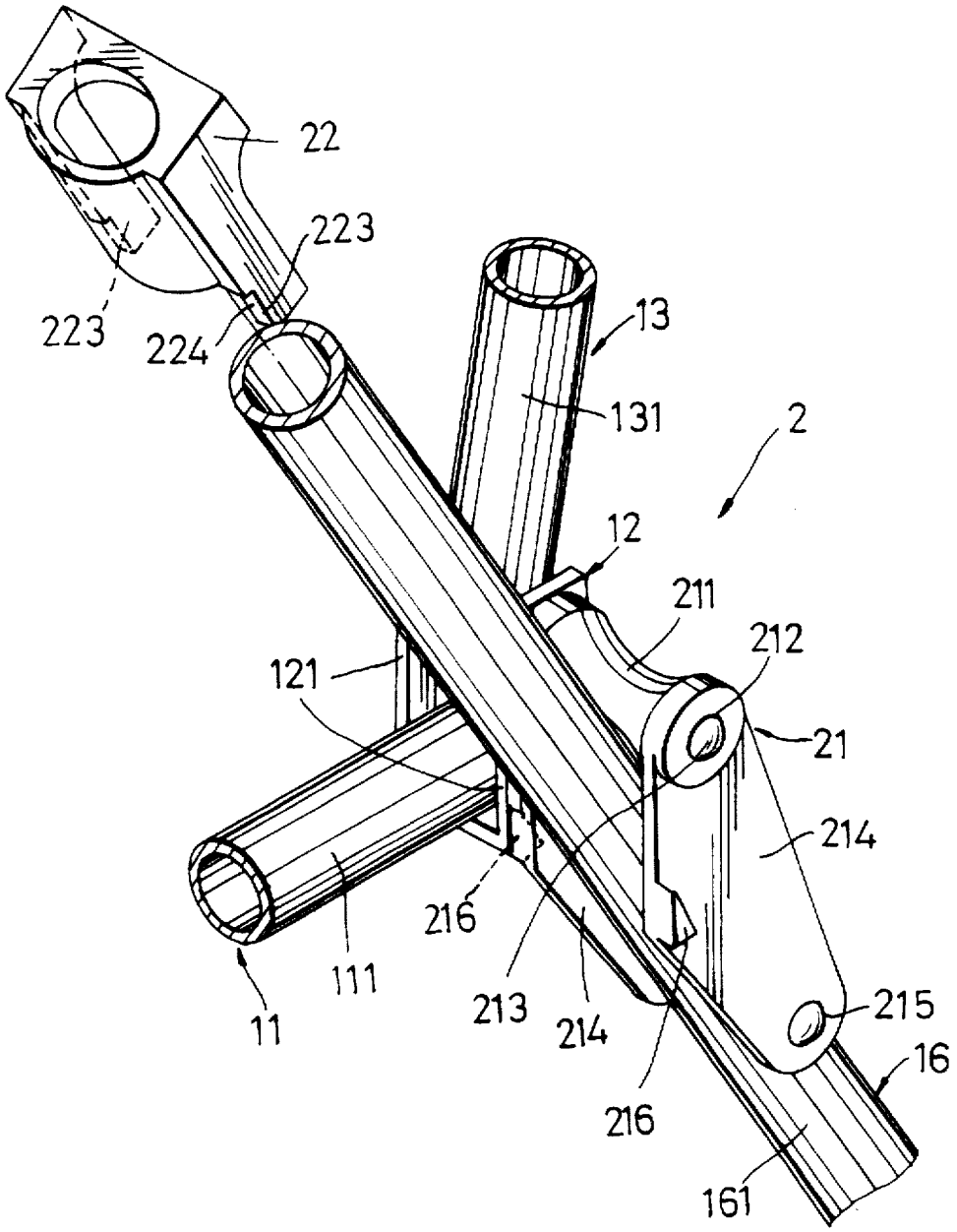
FIG. 3 is an enlarged, partly exploded perspective view illustrating a positioning device of the foldable chair frame of FIG. 2.
Figure 4:
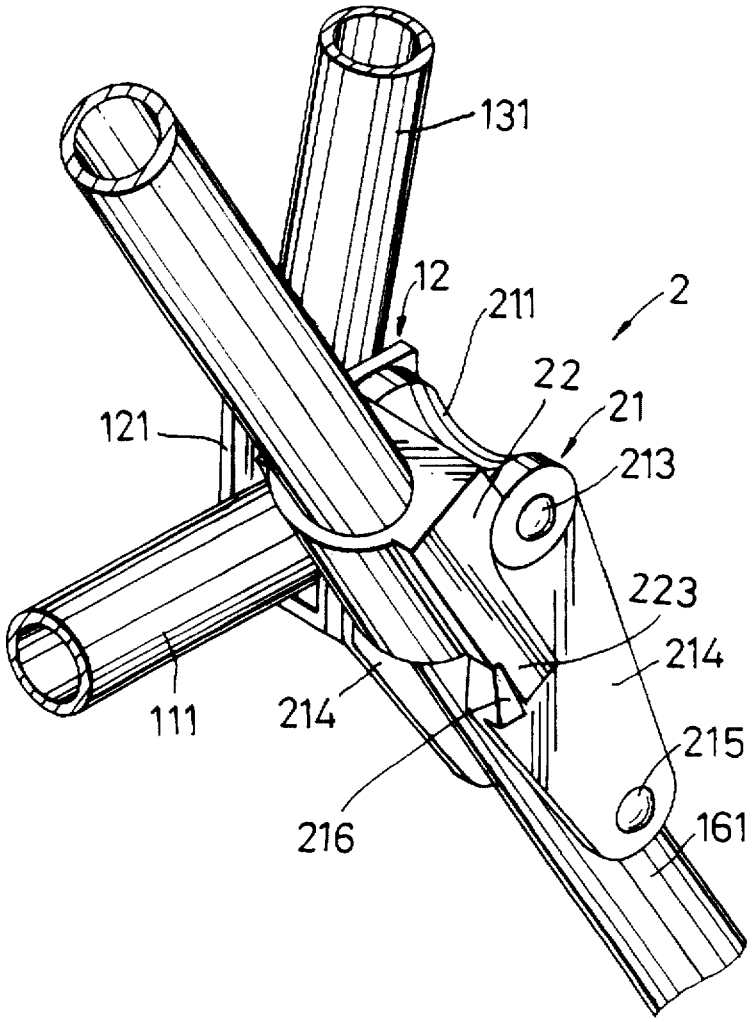
FIG. 4 illustrates the positioning device of the foldable chair frame of FIG. 2 when operated for positioning the chair frame in an unfolded position.

Referring to FIGS. 3 and 4, each of the positioning devices 2 includes a stationary pivot seat 12, a movable pivot seat 21, a first pivot shaft 213, a second pivot shaft 215 and a retaining sleeve 22.

The stationary pivot seat 12 has a parallel pair of first pivot plates 121. The lower end of a respective one of the upright posts 131 of the back frame portion 13 and the rear end of a respective one of the horizontal rails 111 of the seat frame portion 11 extend between the first pivot plates 121. The rear end of each of the horizontal rails 111 of the seat frame portion 11 is mounted pivotally on the first pivot plates 121 by means of a pivot pin 122 (see FIG. 6).

The movable pivot seat 21 has a parallel pair of second pivot plates 214, each of which has an upper end and a lower end, and a tubular connector 211 which extends transversely between the upper ends of the second pivot plates 214 and which confines an axial pivot hole 212 therein. Each of the second pivot plates 214 is triangular in shape and has a corner portion disposed between the upper and lower ends thereof. Each of the second pivot plates 214 has an outer side formed with a retaining protrusion 216 at the corner portion thereof. Each of the retaining protrusions 216 has a triangular cross-section and a rear side with a flat face.

The first pivot shaft 213 extends axially through the pivot hole 212 of the tubular connector 211 of the movable pivot seat 21, the first pivot plates 121 of the stationary pivot seat 12, and the lower end of the respective post 131 of the back frame portion 13 so as to mount pivotally the movable pivot seat 21 on the stationary pivot seat 12 and to mount pivotally the lower end of the respective post 131 on the stationary pivot seat 12.

The second pivot shaft 215 extends through the lower ends of the second pivot plates 214 of the movable pivot seat 21 and through a respective one of the rear legs 161 of the rear support 16 so as to mount pivotally the respective one of the rear legs 161 to the movable pivot seat 21.

The retaining sleeve 22 is sleeved movably on a respective one of the rear legs 161 between an adjacent one of the arm rests 14 and the movable pivot seat 21. The retaining sleeve 22 is formed with an opposite pair of downwardly extending stop members 223, each of which has a front side formed with an L-shaped notch 224. The retaining sleeve 22 is movable along the respective one of the rear legs 161 between a first position, in which the retaining protrusion 216 extends into the L-shaped notch 224 and in which the stop member 223 engages top and rear sides of the retaining protrusion 216 so as to arrest relative movement between the first and second pivot shafts 213, 215 for positioning the foldable chair frame in an unfolded position, as shown in FIGS. 4 and 5, and a second position, in which the stop member 223 is released from the movable pivot seat 21 to permit relative movement between the first and second pivot shaft 213, 215 when the lower ends of the second pivot plates 214 are moved forwardly relative to the upper ends of the second pivot plates 214 due to forward movement of a respective one of the rear legs 161 to fold the chair frame, as shown in FIG. 6.

Figure 5:
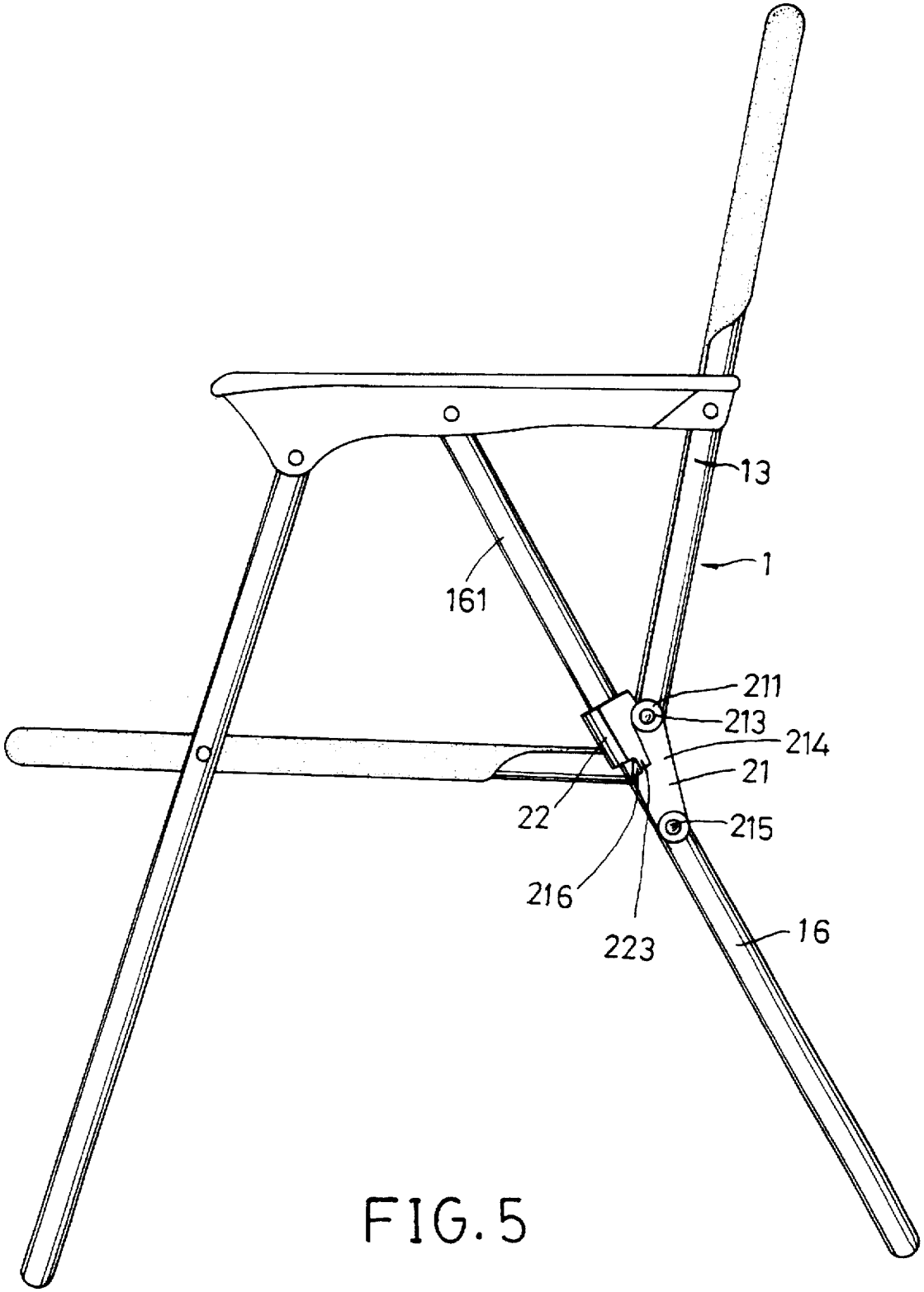
FIG. 5 is a side view illustrating the foldable chair frame of FIG. 2 when positioned in the unfolded position.

Referring to FIG. 5, when the foldable chair frame 1 is unfolded for use, the retaining sleeves 22 are moved downwardly along the rear legs 161 to abut against the tubular connectors 211 of the movable pivot seats 21. The stop members 223 extend to rear sides of the retaining protrusions 216 so as to abut against top and rear sides of the retaining protrusions 216 and to engage the retaining protrusions 216. The lower ends of the second pivot plates 214 are thus prevented from moving forwardly relative to the upper ends thereof. The chair frame 1 can thus be positioned in the unfolded position.

Figure 6:
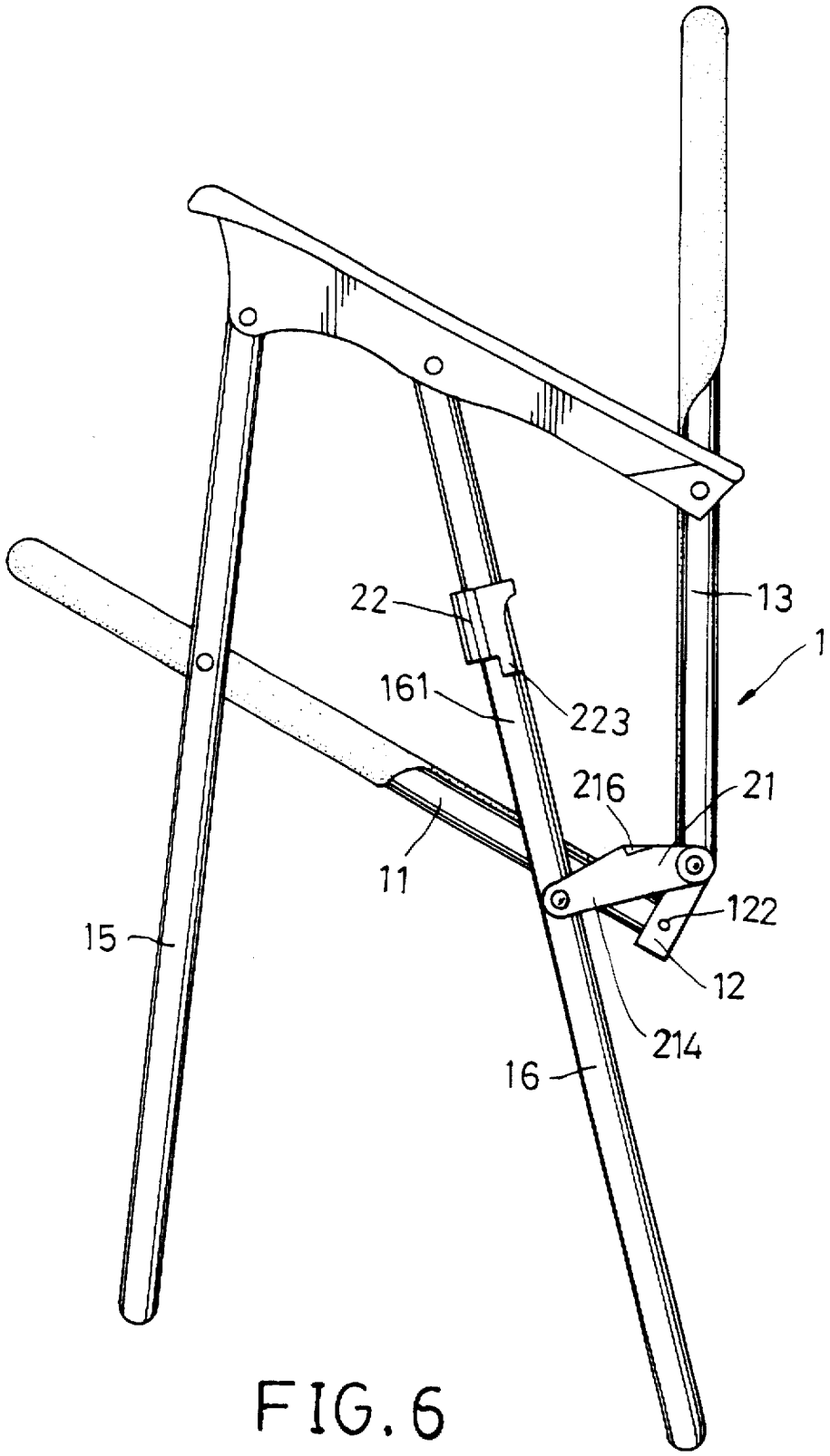
FIG. 6 is a side view illustrating how the foldable chair frame of FIG. 2 is folded.

Referring to FIG. 6, to fold the chair frame 1, the retaining sleeves 22 are moved upwardly along the rear legs 161 so that the stop member 223 is released from the movable pivot seat 21. At this time, the lower ends of the second pivot plates 214 are capable of moving forwardly relative to the upper ends thereof, thereby permitting folding of the rear support 16, the seat frame portion 11, the back frame portion 13 and the front support 15 onto one another to fold the chair frame 1.

Figure 7:
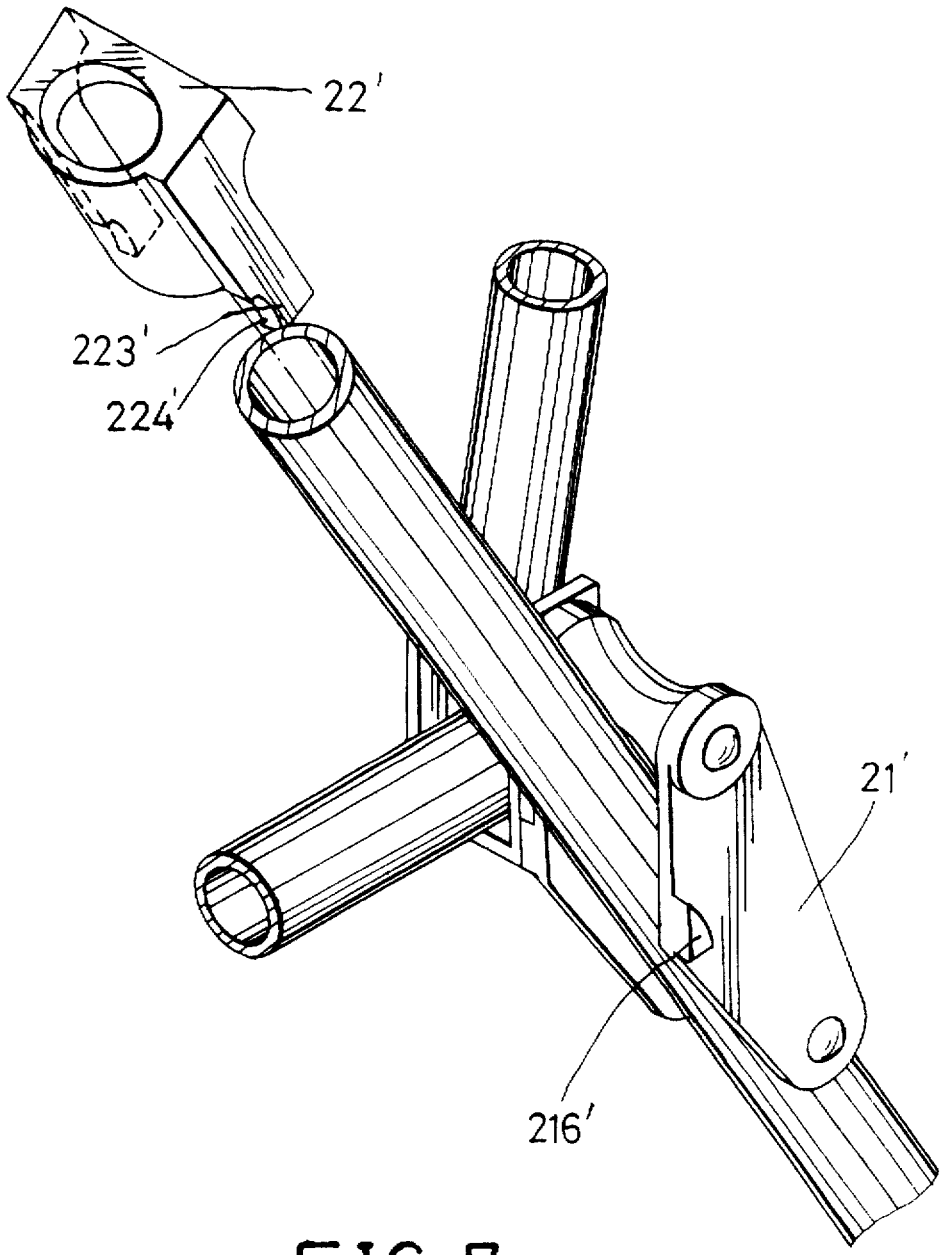
FIG. 7 is an enlarged, partly exploded perspective view illustrating a positioning device of a foldable chair frame according to a second preferred embodiment of the present invention.

It is noted that shapes of the retaining protrusions 216 and the stop members 223 are not critical in the present invention as long as the stop members 223 engage one side of the retaining protrusions 216 to arrest relative movement between the second pivot shafts 215 and the first pivot shafts 213. As shown in FIG. 7, in the second preferred embodiment of the present invention, the retaining protrusion 216' has a rear side with a convex face. The stop member 223' has a front side formed with a notch 224' which has a concave face that complements with the convex face of the retaining protrusion 216'. Operation of the second preferred embodiment is similar to that of the previous embodiment and will not be detailed further.

With this invention thus explained, it is apparent that numerous modifications and variations can be made without departing from the scope and spirit of this invention. It is therefore intended that this invention be limited only as indicated in the appended claims.

I claim:

1. A foldable chair frame comprising:

a back frame portion having a parallel pair of upright posts with lower ends;

a seat frame portion having a parallel pair of horizontal rails with rear ends;

a front support having a parallel pair of front legs, each of which has a lower end adapted to be supported on a ground surface, an upper end, and an intermediate section with a respective one of said rails of said seat frame portion mounted pivotally thereon;

a rear support having a parallel pair of rear legs, each of which has a lower end adapted to be supported on the ground surface, an upper end, and an intermediate portion between said upper and lower ends thereof;

a parallel pair of arm rests disposed on opposite sides of said back frame portion, each of which has a rear end portion mounted pivotally to a respective one of said upright posts of said back frame portion, an intermediate portion with said upper end of a respective one of said rear legs of said rear support mounted pivotally thereon, and a front end portion with said upper end of a respective one of said front legs of said front support mounted pivotally thereon; and a pair of positioning devices, each of which includes:

a stationary pivot seat having a parallel pair of first pivot plates, said lower end of a respective one of said posts of said back frame portion and said rear end of a respective one of said rails of said seat frame portion extending between said first pivot plates and being mounted pivotally on said first pivot plates;

a movable pivot seat having a parallel pair of second pivot plates, each of said second pivot plates having an upper end and a lower end, at least one of said second pivot plates having an outer side formed with a retaining protrusion between said upper and lower ends thereof;

a first pivot shaft which extends transversely through said upper ends of said second pivot plates of said movable pivot seat and through said first pivot plates of said stationary pivot seat so as to mount pivotally said movable pivot seat on said stationary pivot seat;

a second pivot shaft which extends through said lower ends of said second pivot plates of said movable pivot seat and a respective one of said rear legs of said rear support so as to mount pivotally the respective one of said rear legs to said movable pivot seat; and a retaining sleeve which is sleeved movably on a respective one of said rear legs between an adjacent one of said arm rests and said movable pivot seat, said retaining sleeve being formed with a stop member and being movable along the respective one of said rear legs between a first position, in which said stop member engages one side of said retaining protrusion so as to arrest relative movement between said first and second pivot shafts for retaining said foldable chair frame in an unfolded position, and a second position, in which said stop member is released from said movable pivot seat to permit relative movement between said first and second pivot shafts when said lower ends of said second pivot plates are moved forwardly relative to said upper ends of said second pivot plates to fold said chair frame.

* * * * *